US006438778B1

(12) United States Patent
Johnson

(10) Patent No.: US 6,438,778 B1
(45) Date of Patent: Aug. 27, 2002

(54) MULTI-PURPOSE PILLOW

(75) Inventor: Mack Priest Johnson, Cheyenne, WY (US)

(73) Assignee: Maban Corporation, Cheyenne, WY (US)

( * ) Notice: Subject to any disclaimer, the term of this patent is extended or adjusted under 35 U.S.C. 154(b) by 0 days.

(21) Appl. No.: 09/606,636

(22) Filed: Jun. 29, 2000

(51) Int. Cl.[7] ..... A47G 9/10

(52) U.S. Cl. ..... 5/636; 5/639; 5/640; 5/645; 446/473

(58) Field of Search ..... 5/636, 639, 640, 5/645, 652, 656, 657; 446/473; 482/86, 88, 109

(56) References Cited

U.S. PATENT DOCUMENTS 1,637,561 A * 8/1927 French
3,604,026 A * 9/1971 Scheips
4,074,373 A * 2/1978 Garafolo ..... 5/640
4,277,859 A * 7/1981 Seaman ..... 5/639
4,889,512 A * 12/1989 Burnett et al. ..... 5/636
5,522,757 A * 6/1996 Ostrowski
5,598,596 A * 2/1997 Jones et al.
5,652,983 A * 8/1997 Kraemer ..... 5/639

* cited by examiner

*Primary Examiner*—Michael F. Trettel
(74) *Attorney, Agent, or Firm*—Sheridan Ross P.C.

(57) ABSTRACT

A multi-purpose pillow is provided having a pillow portion, and a handle for grasping which is connected to the pillow portion along a hinge. A retaining member may be attached to the handle to enhance the ability of the user to hold on to the pillow during use. The pillow may rotate about the hinge, thus providing a user enhanced or increased force when striking a targeted object. Many uses are contemplated for the invention to include sleeping, recreation, sitting, cleaning of upholstery and rugs, as well as ornamental use of the invention in combination with ornamental components.

26 Claims, 3 Drawing Sheets

MULTI-PURPOSE PILLOW

TECHNICAL FIELD

This invention relates to a multi-purpose pillow, and more particularly, to a multi-purpose pillow which has a handle attached to a pillow portion which can be used to strike objects, among other purposes.

BACKGROUND ART

One of the most enjoyable activities for children today, even in our technologically advancing world of computer games and the like, is pillow fighting. Traditionally, children simply grab the most available pillow in the house and begin pummeling one another. Unfortunately, such spontaneous activity can not only be ruinous to the pillow which is used, but can sometimes be dangerous for the children because the pillow may have fringe or other ornamentation which may inadvertently hurt the child due to its roughened surface or texture. Furthermore, pillows do not have means which allow the user to easily grasp the pillow when the pillow is being swung to make contact with a person or object. Thus, the pillow may be more easily torn, or the user may inadvertently strike the person or object of intended impact with the hand which holds the pillow.

Each of the foregoing disadvantages can be overcome with the invention herein described. Additionally, this invention has multiple uses in addition to pillow fighting or similar recreational activities.

SUMMARY OF THE INVENTION

In accordance with this invention, a multi-purpose pillow is provided which includes a pillow portion, and a handle for grasping which is connected to the pillow portion by means of a hinge which allows the pillow portion to rotate with respect to the handle. Thus, the pillow portion may achieve a swinging or rotating action with respect to the handle which allows the pillow portion to effectively impact a targeted object, and further provides the user stable means by which to grasp the pillow. In a preferred embodiment, the pillow portion may be any type of foam pillow of a desired shape or size. The hinge in the preferred embodiment is simply a seam which is sewn between the pillow portion and the handle, the hinge constituting an area of lesser thickness which allows the pillow portion to rotate about the seam. The handle includes one or more chases or extensions which are filled with stuffing to provide increased rigidity for the handle in comparison to the pillow portion, thus enhancing the user's ability to hold the multi-purpose pillow. A retaining member in the form of a cord or rope is attached to the free end of the handle and may be routed over the user's wrist to further enhance the user's ability to hold the multi-purpose pillow. The retaining member may be twisted the desired number of times about the user's wrist to tighten the retaining member comfortably around the user's wrist.

The pillow portion may also include a pillow cover pocket panel which allows the handle and retaining member to be stored. When stored, the multi-purpose pillow functions as a traditional pillow which can be used for sleep or resting. The pillow cover pocket panel can also be used to store a user's pajamas or other personal articles.

In addition to the invention being usable for recreational pillow fighting and the like, the invention may also be used to beat rugs, sofa cushions, pillows, or other household items which may periodically need to be beaten to remove dust and the like. The handle enables the user to maintain a firm grip, while the pillow portion which rotates about the hinge enables the pillow to deliver an adequate striking force against the targeted object. If desired, the retaining member alone can act as a handle for grasping, depending upon the intended use of the multi-purpose pillow.

Other uses of the multi-purpose pillow could include use for sleeping or resting, or it could be used to sit on like a stadium seat pad. Depending upon the thickness of the pillow portion, it could even be used as a booster seat for a child. These are just some of the intended uses for the multi-purpose pillow, and these uses discussed herein shall not be regarded as limiting the invention to any specific use.

In one modification to the preferred embodiment, an ornament may be attached to the retaining member, and an ornamental covering may be placed over the multi-purpose pillow. One possibility for the ornament attached to the retaining member would include a large button or tab which resembled a doll face, while the ornamental covering could be a doll dress. This combination of an ornament and an ornamental covering used in conjunction with the multi-purpose pillow makes the invention ideal for use also as a child's toy or decoration for a child's room.

Other characteristics and advantages of this invention will become apparent from a review of the following description taken in conjunction with the accompanying drawings.

BEST MODE FOR CARRYING OUT THE INVENTION

Figure 1:
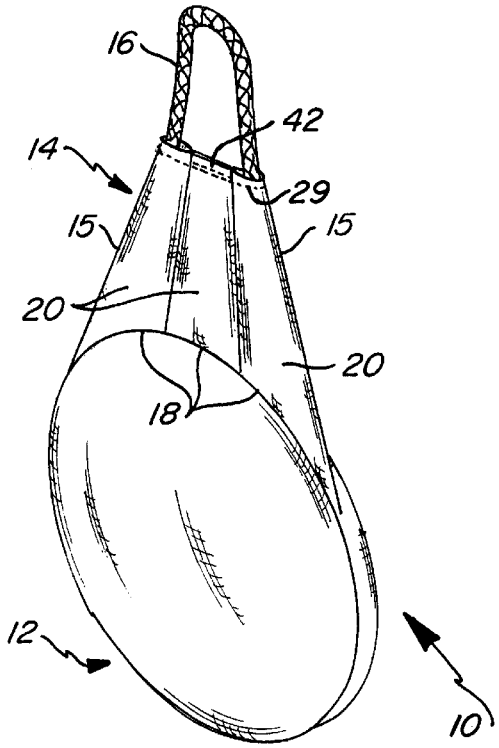
FIG. 1 is a perspective view of the preferred embodiment of the multi-purpose pillow of this invention.
Figure 2:
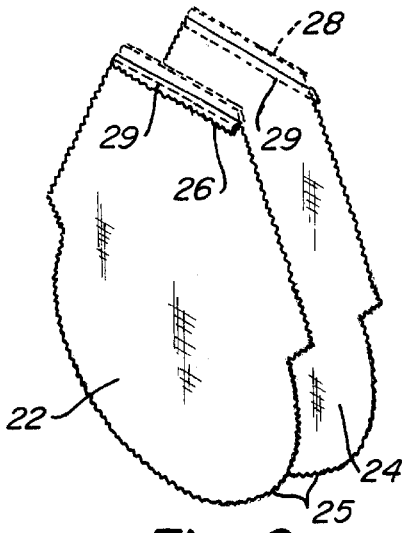
FIG. 2 is an exploded perspective view of components of the multi-purpose pillow illustrating one step in the method of constructing the multi-purpose pillow.

FIG. 1 illustrates a fully assembled multi-purpose pillow in accordance with a preferred embodiment of the invention. As shown, the multi-purpose pillow 10 includes a pillow portion 12, a handle 14 interconnected to the pillow portion along a seamed hinge 18, and a retaining member 16 which attaches to the free end of the handle 14. The handle 14 has two opposing sides 15 which angle toward one another as the handle extends to the retaining member 16. The handle 14 includes one or more handle chases 20 which extend in a direction away from the pillow portion 12, and are somewhat elongate and tubular in shape. The pillow portion 12 is shown as being round; however, it shall be understood that the pillow portion could be rectangular, or any other desired shape.

Figure 3:
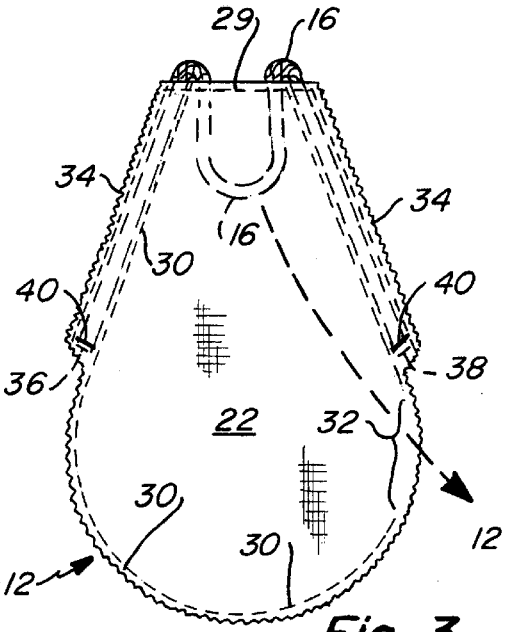
FIG. 3 is a plan or front view illustrating some of the sewing patterns which may be used to construct the multi-purpose pillow in other steps of construction.
Figure 4:
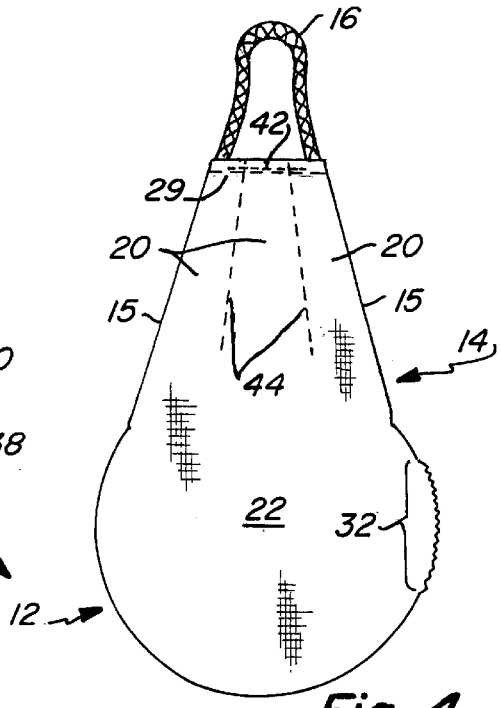
FIG. 4 is another plan or front view illustrating another step in the construction of the multi-purpose pillow.
Figure 5:
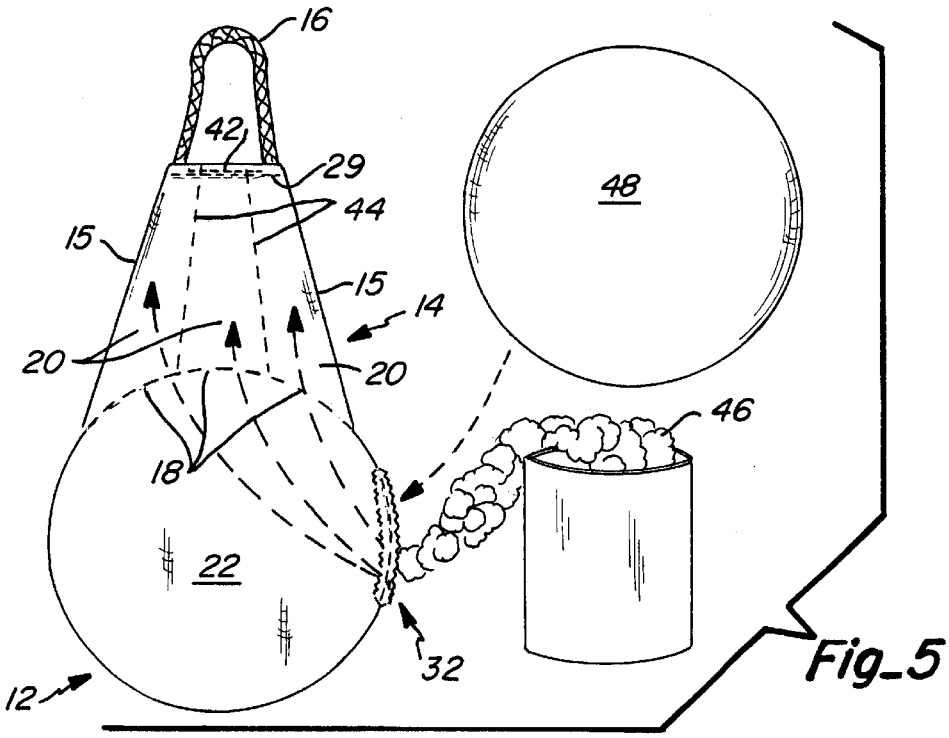
FIG. 5 is yet another plan or front view illustrating yet another step in the construction of the multi-purpose pillow, including stuffing which may be used to fill the handle chases, and a foam pillow insert to complete the pillow portion.

FIGS. 2–5 illustrate one preferred manner in which the multi-purpose pillow of this invention may be constructed. First, beginning with FIG. 2, a pair of panels 22 and 24 are provided which are cut in the contiguous shape of the pillow portion 12 and handle 14. Panels 22 and 24 can be made of cloth, or any other desired similar material. As shown, the panels 22 and 24 may have sheered edges 25 as a result of being cut by pinking shears or the like. Panels 22 and 24 each have upper or top edges 26 and 28, respectively. The top edges 26 and 28 may be folded over as shown, and then sewn back against their respective panels 22 and 24 along seams 29. Next, a main pillow cover and handle seam 30 may be sewn which join the two panels 22 and 24 together. As shown in FIG. 3, seam 30 extends around the periphery of the pillow portion 12, and extends along both sides of the handle 14. A gap 32 is provided allowing the pillow portion and handle to be stuffed, as discussed below. Next, adjacent handle seams 34 may be sewn on both sides of the handle and extending parallel to seam 30. The ends of retaining member 16 may then be inserted through the chases or openings which are defined between seams 30 and 34, on both sides of the handle 14. As shown, ends 36 and 38 of retaining member 16 are routed through these openings. Next, end seams 40 may be sewn such that ends 36 and 38 are sewn to the panels 22 and 24. At this stage in the construction of the device, the multi-purpose pillow 10 is inside out. The multi-purpose pillow is then turned right side out by pulling handle 16 through the gap 32. This results in the appearance of the multi-purpose pillow as shown in FIG. 4. Accordingly, all of the seams 30, 34, and 40 are not exposed. Next, seam 42 may be sewn which further stabilizes the retaining member 16 in handle 14. Seams 44 are also sewn which thereby delineate the specific chases 20. As shown in FIG. 5, stuffing in the form of Polyester(g foam 46 or the like may be used to stuff the chases 20 to the desired rigidity and fullness. Also, a pillow insert 48 is then inserted between the panels 22 and 24. The insert 48 could foam or other well-known types of pillow stuffing. Alternatively, an inflatable pillow insert could be used which would allow the user to adjust the firmness of the pillow portion 12. Finally, the hinge 18 may be sewn between the handle 14 and the pillow portion 12. This hinge 18 may be a double or triple seam to strengthen the hinge 18 as the hinge 18 is subject to increased stress during use of the multi-purpose pillow. Lastly, the gap 32 is sewn shut encapsulating the pillow insert 48 between the panels 22 and 24. If desired, a Velcro® closure member could be added along gap 32 enabling one to remove the pillow insert. However, the Velcro® closure would need to be smooth so that the edge of the pillow portion would not be rough enough to present a hazard.

Figure 6:
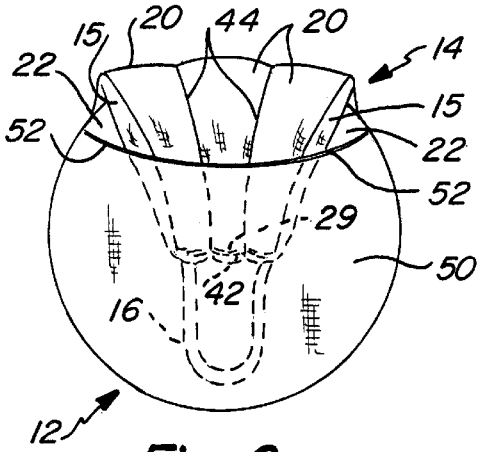
FIG. 6 is a plan or front view of the multi-purpose pillow illustrating the handle and retaining member tucked within the pillow cover pocket panel.

As shown in FIG. 6, a pillow cover pocket panel 50 may be provided which is simply sized to fit the pillow portion 12, and is sewn along the exterior peripheral edges thereof When the multi-purpose pillow is desired to be used simply as a pillow, then the retaining member 16 and handle 14 may be stored by tucking them between the pocket panel 50 and the adjacent panel 22/24. The upper edge of pocket panel 50 is shown as upper edge 52.

Figure 7:
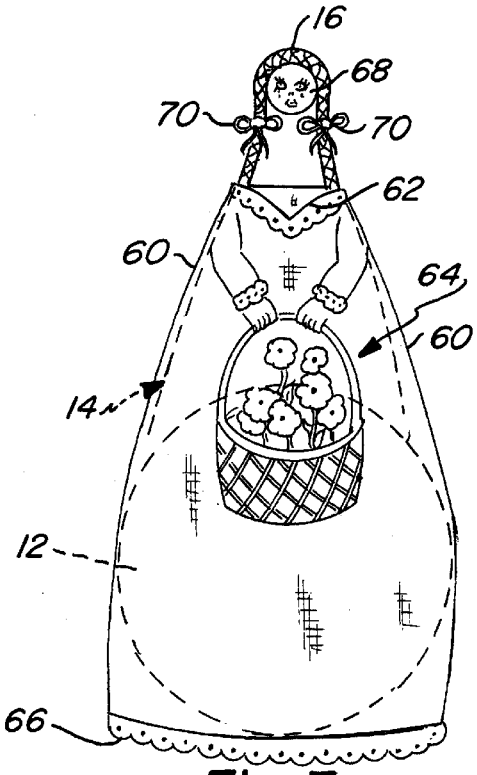
FIG. 7 is another plan or front view of the multi-purpose pillow in combination with an ornament attached to the retaining member and an ornamental covering placed over the handle and pillow portion.

The preferred embodiment of the multi-purpose pillow of this invention can be also modified to include an ornamental covering 60. As shown in FIG. 7, the ornamental covering 60 may be in the form a doll dress having a neck portion 62 which surrounds the retaining member 16. The ornamental covering 60 may have a print design 64 or the like as desired to illustrate the desired doll dress. Also shown is fringe 66 which may be sewn along the bottom of the ornamental covering 60. The ornamental covering 60 extends over the bottom portion of the retaining member 16, and over the handle 14 and pillow portion 12. An ornament 68 may be secured to the loop of the retaining member 16, as by clips or the like. The ornament 68 may be in the form of a doll face, photograph of a person's face, or any other desired design. As also shown, bows 70 can be tied to the retaining member 16. The addition of the ornamental covering 60, ornament 68 and bows 70 make the multi-purpose pillow appear as a doll.

Figure 8:
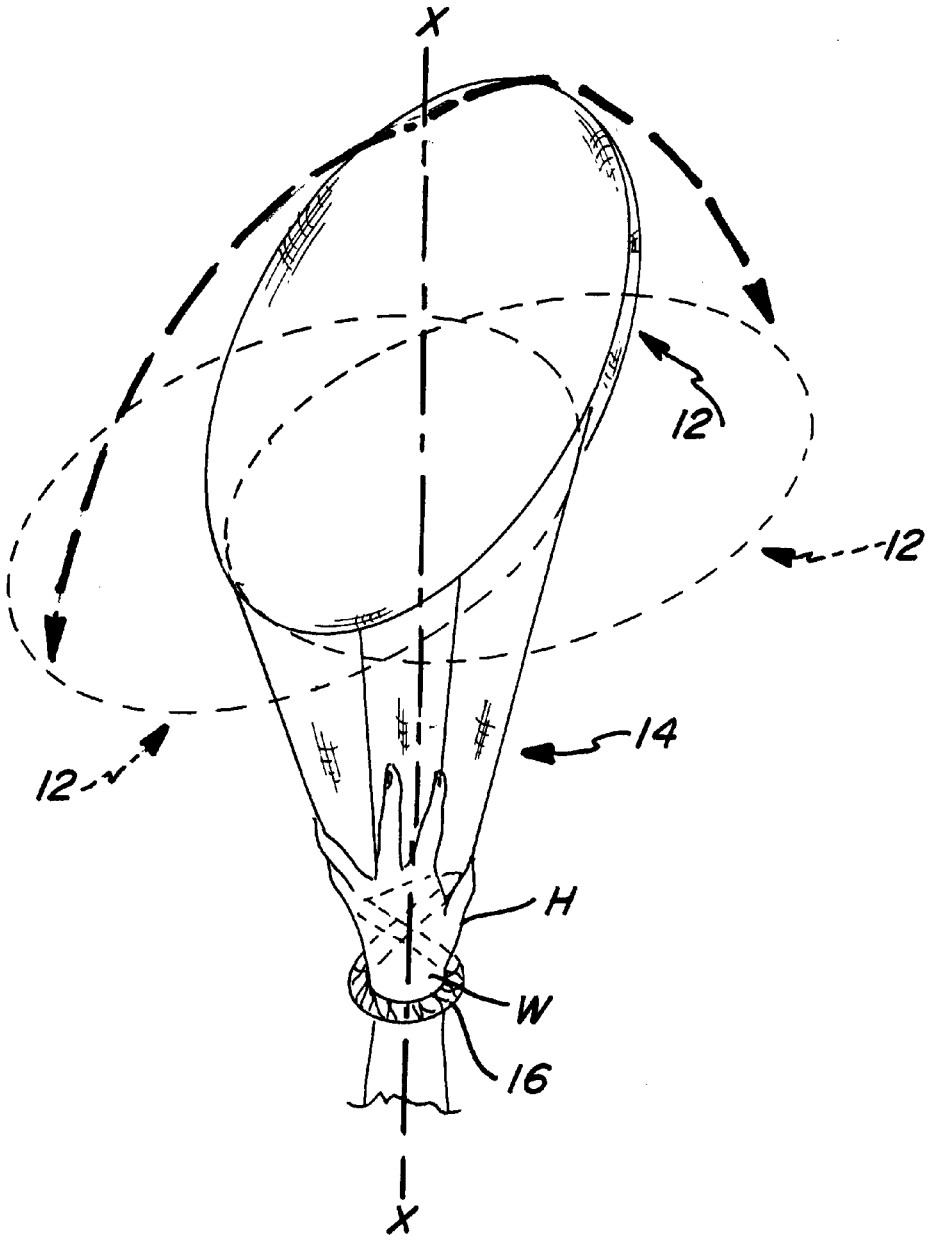
FIG. 8 is a perspective view of the multi-purpose pillow in use.

As shown in FIG. 8, the hand H of the user grasps the handle 14, and the retaining member 16 is positioned over the wrist W. As shown, the retaining member 16 has a single twist which snugly secures the retaining member 16 around the user's wrist W. FIG. 8 illustrates the swinging action which may take place by a user who wishes to strike an object. As shown, the handle 14 and the pillow portion initially lie along axis XX, and as the user swings the pillow 10, the pillow 10 may rotate about hinge 18 away from axis XX in either direction away from the axis.

Although the handle 14 is described as the portion grasped for pillow fighting, the retainer member 16 can also be used as a handle for carrying the pillow 10 or for striking objects such as rugs for cleaning. Accordingly, the retainer member 16 would simply be grasped and not the handle 14.

By the foregoing, it is clear that the multi-purpose pillow of this invention has many uses to include sleeping, recreation, cleaning, sitting or use of the invention in combination with ornamentation. Although a specific method of construction has been described in detail, it shall be understood that there are many ways in which to construct the invention, and the invention shall not be limited by the specific method of construction described herein. For example, the pillow portion 12 and handle 14 could be made of separate sections of material sewn together in lieu of the continuous panels 22 and 24. The various seams illustrated in FIGS. 2–5 can also be modified as desired. In addition to the seam hinge 18, other means could be provided to enhance the pillow portion's 12 ability to swing or hinge away from the handle 14. For example, in addition to seam hinge 18, one could utilize a strip of semi-rigid material such as plastic, and then interconnect the handle and abutting edge of the pillow portion to the plastic strip. The naturally narrowed sections of the handle and pillow portion extending along the plastic strip would further stabilize and strengthen the hinge 18.

This invention has been described in detail with reference to a particular embodiment thereof, but it will be understood that various other modifications can be effected within the spirit and scope of the invention.

I claim:

1. A multi-purpose pillow comprising:

a pillow portion; and a handle having proximal and distal ends, said distal end connected to said pillow portion along a pillow hinge, enabling said pillow portion to rotate about said pillow hinge said pillow hinge defining an interface between said distal end of said handle and an edge of said pillow portion, said pillow portion having a greater thickness adjacent said edge thereof in comparison to said distal end of said handle, and said interface being narrower in thickness than said distal end of said handle and said edge of said pillow portion.

2. A pillow, as claimed in claim 1, further comprising:

a retaining member connected to said handle.

3. A pillow, as claimed in claim 2, further including:

an ornament attached to said retaining member.

4. A pillow, as claimed in claim 1, wherein sid handle further comprises:

a plurality of handle chases, and stuffing inserted in said handle cases for providing stiffening support to said handle.

5. A pillow, as claimed in claim 1, wherein:

said pillow hinge includes a seam sewn between said pillow portion and said handle.

6. A pillow, as claimed in claim 1, wherein:

said pillow portion comprises a pair of pillow cover panels sewn together, and a pillow insert inserted between said pair of pillow cover panels.

7. A pillow, as claimed in claim 1, wherein:

said retaining member is twisted.

8. A pillow, as claimed in claim 1, further including:

a closure member positioned along said edge of said pillow portion enabling removing of contents within said pillow portion.

9. A pillow, as claimed in claim 1, wherein:

said handle and said pillow portion lie in a normal position along an axis, and said handle extends away from said pillow along said axis, said pillow hinge enabling said pillow portion to rotate in selective positions out of said axis.

10. A pillow, as claimed in claim 1, further comprising:

an ornamental covering positioned over said multi-purpose pillow.

11. A multipurpose pillow comprising:

a pillow portion;

a handle connected to said pillow portion along a pillow hinge enabling said pillow portion to rotate about said pillow hinge a retaining member connected to said handle; and said retaining member includes a cord having first and second ends, each said ends attached to said handle thus forming a loop.

12. A multipurpose pillow comprising:

a pillow portion;

a handle connected to said pillow portion along a pillow hinge enabling said pillow portion to rotate about said pillow hinge; and a pillow cover pocket panel attached to said pillow portion enabling storage of said handle and said retaining member between said pillow portion and said pillow cover pocket panel.

13. A multipurpose pillow comprising:

a pillow portion;

a handle connected to said pillow portion along a pillow hinge enabling said pillow portion to rotate about said pillow hinge;

an ornamental covering positioned over said multi-purpose pillow; wherein said ornamental covering includes a doll dress having a neck portion surrounding said retaining member, and said doll dress extending over said handle and said pillow portion.

14. A multi-purpose pillow comprising:

a pillow portion;

a handle having proximal and distal ends; and means for hingedly securing said handle to said pillow portion enabling said pillow portion to rotate about said means for securing, said means for securing defining an interface between said distal end of said handle and an edge of said pillow portion, said pillow portion having a greater thickness at said edge thereof in comparison to said distal end of said handle, and said interface being narrower in thickness than said distal end of said handle and said edge of said pillow portion.

15. A pillow, as claimed in claim 14, further comprising:

a retaining member connected to said handle.

16. A pillow, as claimed in claim 14, wherein said handle further comprises:

a plurality of handle chases, and stuffing inserted in said handle chases for providing stiffening support to said handle.

17. A pillow, as claimed in claim 14, wherein:

said means for hingedly securing includes a seam sewn between said pillow portion and said handle.

18. A pillow, as claimed in claim 14, wherein:

said pillow portion comprises a pair of pillow cover panels sewn together, and a pillow insert inserted between said pair of pillow cover panels.

19. A pillow, as claimed in claim 14, further including:

an ornament attached to said loop of said retaining member.

20. A pillow, as claimed in claim 14, further comprising:

an ornamental covering positioned over said multi-purpose pillow.

21. A pillow, as claimed in claim 14, wherein:

said retaining member is twisted.

22. A pillow, as claimed in claim 14, further including:

a closure member positioned along said edge of said pillow portion enabling removing of contents within said pillow portion.

23. A pillow, as claimed in claim 14, wherein:

said handle and said pillow portion lie in a normal position along an axis, and said handle extends away from said pillow along said axis, said means for hingedly securing enabling said pillow portion to rotate out of said axis.

24. A multipurpose pillow comprising:

a pillow portion;

a handle;

a retaining member connected to said handle;

means for hingedly securing said handle to said pillow portion enabling said pillow portion to rotate about said means for securing; and wherein said retaining member includes a cord having first and second ends, each said ends attached to said handle thus forming a loop.

25. A multipurpose pillow comprising:

a pillow portion;

a handle;

means for hingedly securing said handle to said pillow portion enabling said pillow portion to rotate about said means for securing; and a pillow cover pocket panel attached to said pillow portion enabling storage of said handle and said retaining member between said pillow portion and said pillow cover pocket panel.

26. A multipurpose pillow comprising:

a pillow portion;

a handle;

means for hingedly securing said handle to said pillow portion enabling said pillow portion to rotate about said means for securing;

an ornamental covering positioned over said multipurpose pillow; and wherein said ornamental covering includes a doll dress having a neck portion surrounding said retaining member, and said doll dress extending over said handle and said pillow portion.

* * * * *

UNITED STATES PATENT AND TRADEMARK OFFICE

CERTIFICATE OF CORRECTION

PATENT NO. : 6,438,778 B1
DATED : August 27, 2002
INVENTOR(S) : Johnson

It is certified that error appears in the above-identified patent and that said Letters Patent is hereby corrected as shown below:

Column 5,
Line 5, please replace “sid” with -- said --.
Line 8, please replace “cases” with -- chases --.

Signed and Sealed this

Fifteenth Day of October, 2002

*Attest:*

*Attesting Officer*

JAMES E. ROGAN
*Director of the United States Patent and Trademark Office*